US011261050B2

(12) United States Patent
Tamura

(10) Patent No.: US 11,261,050 B2
(45) **Date of Patent: *Mar. 1, 2022**

(54) COATING FILM TRANSFER TOOL

(71) Applicant: Tombow Pencil Co., Ltd., Tokyo (JP)

(72) Inventor: Yutaka Tamura, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/737,757

(22) Filed: Jan. 8, 2020

(65) Prior Publication Data

US 2020/0139747 A1 May 7, 2020

Related U.S. Application Data

(63) Continuation of application No. 15/534,698, filed as application No. PCT/JP2015/068430 on Jun. 25, 2015, now Pat. No. 10,668,767.

(30) Foreign Application Priority Data

Dec. 9, 2014 (JP) ..... JP2014-248700

(51) Int. Cl.
*B65H 37/00* (2006.01)
*B43L 19/00* (2006.01)
(Continued)

(52) U.S. Cl.
CPC ..... *B65H 37/007* (2013.01); *B43L 19/00* (2013.01); *B65H 54/86* (2013.01);
(Continued)

(58) Field of Classification Search
CPC ..... B43M 11/06; B65H 37/007; B65H 75/486
See application file for complete search history.

(56) References Cited

U.S. PATENT DOCUMENTS 5,234,734 A 8/1993 Hamada
6,776,209 B1 8/2004 You
(Continued)

FOREIGN PATENT DOCUMENTS

EP 1273544 A1 1/2003
JP 04144798 A 5/1992
(Continued)

OTHER PUBLICATIONS

JIS K 5601-2-2, "Testing methods for paint components—Part 2: Components analysis in solvent soluble matter—Section 2: Softening point (Ring and ball method)", journal, published Apr. 20, 1999, Japanese Standards Association, Tokyo, Japan.
(Continued)

*Primary Examiner* — Philip C Tucker
*Assistant Examiner* — John Blades
(74) *Attorney, Agent, or Firm* — Kolitch Romano LLP

(57) ABSTRACT

A coating film transfer tool in which a rotational torque with the least variability may be generated without being affected by a surface state of a resilient body may include: a paying-out core having a coating film transfer tape wound thereon; and a rewinding core that rewinds the coating film transfer tape after use. The paying-out core and the rewinding core are interlocked via a power transmission mechanism in a case. The transmission mechanism generates a rotational torque by a frictional force on a sliding surface between components, by using a restoring force of a resilient body. The resilient body is configured to rotate integrally with a component A that comes into contact with one end of the resilient body and a component B that comes into contact with the other end.

8 Claims, 13 Drawing Sheets

(51) Int. Cl.

| | |
|---|---|
| ***B65H 54/86*** | (2006.01) |
| ***B65H 75/44*** | (2006.01) |
| ***B65H 75/48*** | (2006.01) |
| *B43M 11/06* | (2006.01) |

(52) U.S. Cl.
CPC ..... *B65H 75/4431* (2013.01); *B65H 75/486* (2013.01); *B43M 11/06* (2013.01); *B65H 2601/522* (2013.01); *B65H 2701/377* (2013.01)

(56) References Cited

U.S. PATENT DOCUMENTS

| | | | |
|---|---|---|---|
| 7,070,051 | B2 | 7/2006 | Kanner |
| 2005/0056376 | A1 | 3/2005 | Marschand |
| 2005/0150606 | A1 | 7/2005 | Marschand |
| 2006/0251888 | A1 | 11/2006 | Lane |
| 2006/0251889 | A1 | 11/2006 | Lane |
| 2006/0251890 | A1 | 11/2006 | Lane |
| 2006/0263596 | A1 | 11/2006 | Bamborough |
| 2007/0218276 | A1 | 9/2007 | Hiramatsu |
| 2007/0231571 | A1 | 10/2007 | Lane |
| 2008/0173406 | A1 | 7/2008 | Wu |
| 2010/0139707 | A1 | 6/2010 | Boonstra |
| 2011/0000622 | A1 | 1/2011 | Rolion et al. |
| 2014/0023858 | A1 | 1/2014 | Igarashi |

FOREIGN PATENT DOCUMENTS

| | | | | |
|---|---|---|---|---|
| JP | 10217688 | A | 8/1998 | |
| JP | 2001240812 | A | 9/2001 | |
| JP | 2004299602 | A | 10/2004 | |
| JP | 2005-047201 | * | 2/2005 | ..... B43L 19/00 |
| JP | 2006123544 | A | 5/2006 | |
| JP | 2006281495 | A | 10/2006 | |
| JP | 2007154022 | A | 6/2007 | |
| JP | 2007295776 | A | 11/2007 | |
| JP | 2007307874 | A | 11/2007 | |
| JP | 2008096389 | A | 4/2008 | |
| JP | 2008162052 | A | 7/2008 | |
| JP | 2009083403 | A | 4/2009 | |
| JP | 2010002733 | A | 1/2010 | |
| JP | 2010037936 | A | 2/2010 | |
| JP | 2012195747 | A | 10/2012 | |
| JP | 2014011139 | A | 1/2014 | |
| WO | 9615060 | A1 | 5/1996 | |

OTHER PUBLICATIONS

U.S. Patent Office, Office Action dated Mar. 25, 2020 in U.S. Appl. No. 16/628,238, which is related to this US Application.

* cited by examiner

PRIOR ART

COATING FILM TRANSFER TOOL

CROSS-REFERENCE TO RELATED APPLICATIONS

This application is a continuation of U.S. patent application Ser. No. 15/534,698, which is a national phase application of PCT/JP2015/068430, filed Jun. 25, 2015, which in turn claims priority to Japanese Patent Application No. 2014-248700, filed Dec. 9, 2014, each of which is hereby incorporated by reference.

TECHNICAL FIELD

The present invention relates to a coating film transfer tool provided with a coating film transfer tape for correction, for adhesion, or the like.

BACKGROUND ART

In general, widely used as a coating film transfer tool is an automatically winding type coating film transfer tool in which a paying-out core having a coating film transfer tape wound thereon and a rewinding core that rewinds the coating film transfer tape after use are interlocked via a power transmission mechanism in a case, and a rotational torque of the rewinding core or the paying-out core is generated by a frictional force generating on a sliding surface between components by using a restoring force of a resilient body. Publicly known specific examples of a mode using a restoring force of a resilient body include configurations using resiliency of a resin as described in PTL 1, resiliency of an O-ring as described in PTL 2, and resiliency of a compression spring as described in PTL 3.

Among these configurations, the ones using resiliency of a resin or an O-ring are affected by creep, and thus have difficulty in adjustment of a rotational torque. The ones using resiliency of a compression spring, being less affected by creep and achieving a load stable for a long time, are easy to adjust.

FIG. 11 to FIG. 13 illustrate a mode of a general coating film transfer tool of the related art in which resiliency of a compression spring is used.

FIG. 11 is a front view of a coating film transfer tool 100. FIG. 12 is an enlarged vertical cross-sectional view taken along the line XII-XII in FIG. 11. FIG. 13 is an exploded perspective view of a principal portion in FIG. 12 which is reduced in scale. Two members of a compression spring 104 and a paying-out core gear 105 are fitted in sequence on a resilient locking piece 102 of a rewinding button 103, which has a locking portion 101 at an end thereof. The resilient locking piece 102 of the rewinding button 103 is rotatably fitted on a support shaft 107 projecting inward of a case 106. The rewinding button 103 and a paying-out core 108 are configured to rotate integrally with each other. In this configuration, frictional forces generating on a sliding surface (dotted circle X) between the compression spring 104 and the rewinding button 103, a sliding surface (dotted circle Y) between the compression spring 104 and the paying-out core gear 105, a sliding surface (dotted circle Z1) between the paying-out core gear 105 and the paying-out core 108, and a sliding surface (dotted circle Z2) between the locking portion 101 of the rewinding button 103 and the paying-out core gear 105 generate a rotational torque of the rewinding core via a power transmission mechanism.

In contrast, with generally available compression springs, it is difficult to manage a surface condition of the wire.

Therefore, since the coil wires to be used have different surface states, friction generated with respect to mating members varies. This leads to a problem of high variability in generated rotational torque.

In addition, it is not constant whether the compression spring slides on a rewinding button or with a paying-out core gear, and the portion of the compression spring which slides on these members is also not always the same, so that variability may result. If the variability in rotational torque is high, the rotational torque needs to be set to a relatively high value, to wind a coating film transfer tape even at the lowest expected rotational torque. However, if the rotational torque is excessively high, usability is worsened because a larger force is required for transfer and, in addition. The surface of the compression spring may also cause earlier wearing of the mating member. Consequently, there is a problem that the rotational torque changes between the initial use and final use.

CITATION LIST

Patent Literatures

PTL 1: JP-A-2011-121204
PTL 2: Japanese Patent No. 2,876,301
PTL 3: Japanese Patent No. 3,870,986

SUMMARY OF INVENTION

Technical Problem

In view of such circumstances described above, it is an object of the present invention to provide a coating film transfer tool capable of generating a rotational torque with the least variability possible without being affected by a surface state of the resilient body, and more preferably, capable of achieving long-term stability of a rotational torque without being affected by creep and without variations in rotational torque from an early stage of usage to a final stage of usage.

Solution to Problem

According to the present invention, the above-described problem is solved by the following means.

(1) There is provided an automatically winding type coating film transfer tool including: a paying-out core having a coating film transfer tape wound thereon; and a rewinding core that rewinds the coating film transfer tape after use, the paying-out core and the rewinding core being interlocked via a power transmission mechanism in a case and generating a rotational torque of the rewinding core or the paying-out core by a frictional force generating on a sliding surface between components by using a restoring force of a resilient body, in which the resilient body is configured to rotate integrally with a component A that comes into contact with one end of the resilient body and a component B that comes into contact with the other end.

In this configuration, a rotational torque with the least variability may be generated without being affected by a surface state of a resilient body, so that stability of the rotational torque is achieved.

(2) In the section (1), the resilient body is a compression spring.

In this configuration, long-term stability of rotational torque is achieved without being much affected by creep and without variations in rotational torque from an early stage of usage to a final stage of usage.

(3) In the sections (1) or (2) described above, a frictional force generating on a sliding surface between a C component, which is positioned on an opposite side of the resilient body with respect to the A component positioned in-between, and the A component by sliding contact therebetween serves as at least part of the rotational torque of the rewinding core or of the paying-out core.

In this configuration, the rotational torque that is not susceptible to the surface state of the resilient body (such as the compression spring) may be obtained.

(4) In any one of the sections (1) to (3) described above, a frictional force generating on a sliding surface between a D component, which is positioned on an opposite side of the resilient body with respect to the B component positioned in-between, and the B component by sliding contact therebetween serves as at least part of the rotational torque of the rewinding core or of the paying-out core.

In this configuration, the rotational torque that is not susceptible to the surface state of the resilient body (such as the compression spring) may be obtained.

(5) In the section (3) described above, three members of the resilient body, an annular spacer (A component), and an annular resilient body stopper (C component) rotating integrally with the paying-out core are fitted in sequence on a cylindrical rotating shaft of a paying-out core gear (component B) having a locking portion at an end thereof and are retained by the locking portion, the rotational shaft of the paying-out core gear is rotatably fitted on a support shaft projecting inward of the case, and the paying-out core gear and the resilient body and the spacer rotate integrally, so that frictional forces generating on a sliding surface between the spacer and the resilient body stopper and a sliding surface between the resilient body stopper and the locking portion of the paying-out core gear serve as at least part of the rotational torque of the rewinding core via the power transmission mechanism.

In this configuration, a rotational torque with the least variability may be generated without being affected by a surface state of a resilient body.

(6) In the section (4) described above that quotes the section (3), three members of an annular spacer (B component), the resilient body, and an annular resilient body stopper (A component) rotating integrally with the paying-out core are fitted in sequence on a cylindrical rotating shaft of a paying-out core gear (D component) having a locking portion at an end thereof and are retained by the locking portion, the rotating shaft of the paying-out core gear is rotatably fitted on a support shaft projecting inward of the case, the spacer and the resilient body and the resilient body stopper rotate integrally, so that frictional forces generating on a sliding surface between the spacer and the paying-out core gear and a sliding surface between the resilient body stopper and the paying-out core gear and the locking portion (C component) thereof serve as at least part of the rotational torque of the rewinding core via the power transmission mechanism.

In this configuration, a rotational torque with the least variability may be generated without being affected by a surface state of a resilient body.

(7) In the section (4) described above that quotes the section (3), three members of a small diameter portion (B component) of the paying-out core, which is reduced in diameter at an end facing a paying-out core gear, the resilient body, and an annular resilient body stopper (A component) are fitted in sequence on a cylindrical rotating shaft of the paying-out core gear (D component) having a locking portion at an end thereof and are retained by the locking portion, the rotating shaft of the paying-out core gear is rotatably fitted on a support shaft projecting inward of the case, the paying-out core and the resilient body and the resilient body stopper rotate integrally, so that frictional forces generating on a sliding surface on the paying-out core and the paying-out core gear (D component) and a sliding surface between the resilient body stopper and the locking portion (C component) of the paying-out core gear serve as at least part of the rotational torque of the rewinding core via the power transmission mechanism.

In this configuration, a rotational torque with the least variability may be generated without being affected by a surface state of a resilient body.

(8) In the section (4) described above that quotes the section (1) or (2), three members of the resilient body, a small diameter portion (B component) of the paying-out core, which is reduced in diameter at an end facing a paying-out core gear (D component), and the paying-out core gear are fitted in sequence on a resilient locking piece of a rewinding button (A component) having a locking portion at an end thereof and are retained by the locking portion, the resilient locking piece of the rewinding button is rotatably fitted on a support shaft projecting inward of the case, the rewinding button and the resilient body and the paying-out core rotate integrally, so that frictional forces generating on a sliding surface between the paying-out core and the paying-out core gear and a sliding surface between the paying-out core gear and the locking portion of the resilient locking piece of the rewinding button serve as at least part of the rotational torque of the rewinding core via the power transmission mechanism.

In this configuration, a rotational torque with the least variability may be generated without being affected by a surface state of a resilient body.

(9) In the section (3) described above, four members of the resilient body, an annular first spacer (A component), an annular resilient body stopper (C component) rotating integrally with the paying-out core, and an annular second spacer are fitted in sequence on a cylindrical rotating shaft of a paying-out core gear (component B) having a locking portion at an end thereof and are retained by the locking portion, the rotating shaft of the paying-out core gear is rotatably fitted on a support shaft projecting inward of the case, the paying-out core gear and the resilient body, and the first spacer and the second spacer rotate integrally, so that frictional forces generating on a sliding surface between the first spacer and the resilient body stopper and a sliding surface between the resilient body stopper and the second spacer serve as at least part of the rotational torque of the rewinding core via the power transmission mechanism.

In this configuration, a rotational torque with the least variability may be generated without being affected by a surface state of a resilient body.

Advantageous Effects of Invention

According to the present invention, it is possible to generate a rotational torque with as little variability as possible without being affected by a surface state of the resilient body, and without changing a rotational torque from an early stage of usage to a final stage of usage. When a compression spring is used as a further preferable resilient body, long-term stability of a rotational torque may be obtained with little influence of creep.

DETAILED DESCRIPTION OF THE DRAWINGS

Embodiments of the present invention in which a compression spring is used as a resilient body will be described below. To achieve full effect of the present invention, the compression spring is the most preferable as the resilient body. However the resilient body which may be used in the present invention is not limited to the compression spring, and any suitable resilient bodies such as an O-ring may be used.

The present invention provides an automatically winding type coating film transfer tool in which a paying-out core having a coating film transfer tape wound thereon and a rewinding core that rewinds the coating film transfer tape after use are interlocked via a power transmission mechanism in a case. A rotational torque of the rewinding core or the paying-out core is generated by a frictional force generating on a sliding surface between components by using a restoring force of a resilient body, characterized in that the resilient body is configured to rotate integrally with a component A that comes into contact with one end of the resilient body and a component B that comes into contact with the other end.

Specific, illustrative forms of the frictional force that generates the rotational torque will now be described: A first mode may be used, in which a frictional force generating on a sliding surface between a C component, which is positioned on an opposite side of the resilient body with respect to the A component positioned in-between, and the A component by sliding contact therebetween serves as at least part of the rotational torque of the rewinding core or of the paying-out core. Alternatively, a second mode may be used, in which a frictional force generating on a sliding surface between a D component, which is positioned on an opposite side of the resilient body with respect to the B component positioned in-between, and the B component by sliding contact therebetween serves as at least part of the rotational torque of the rewinding core or of the paying-out core.

Specifics of the A to D components depend on the embodiment. For example, the A component may include a spacer, a resilient body stopper, and/or a rewinding button. For example, the B component may include a spacer, a small or reduced diameter portion of the paying-out core, and/or a paying-out core gear. For example, the C component may include the resilient body stopper and/or a locking portion of the paying-out core gear. For example, the D component may include the paying-out core gear and/or the like. Detailed description will be given below.

EXAMPLE 1

Figure 1:
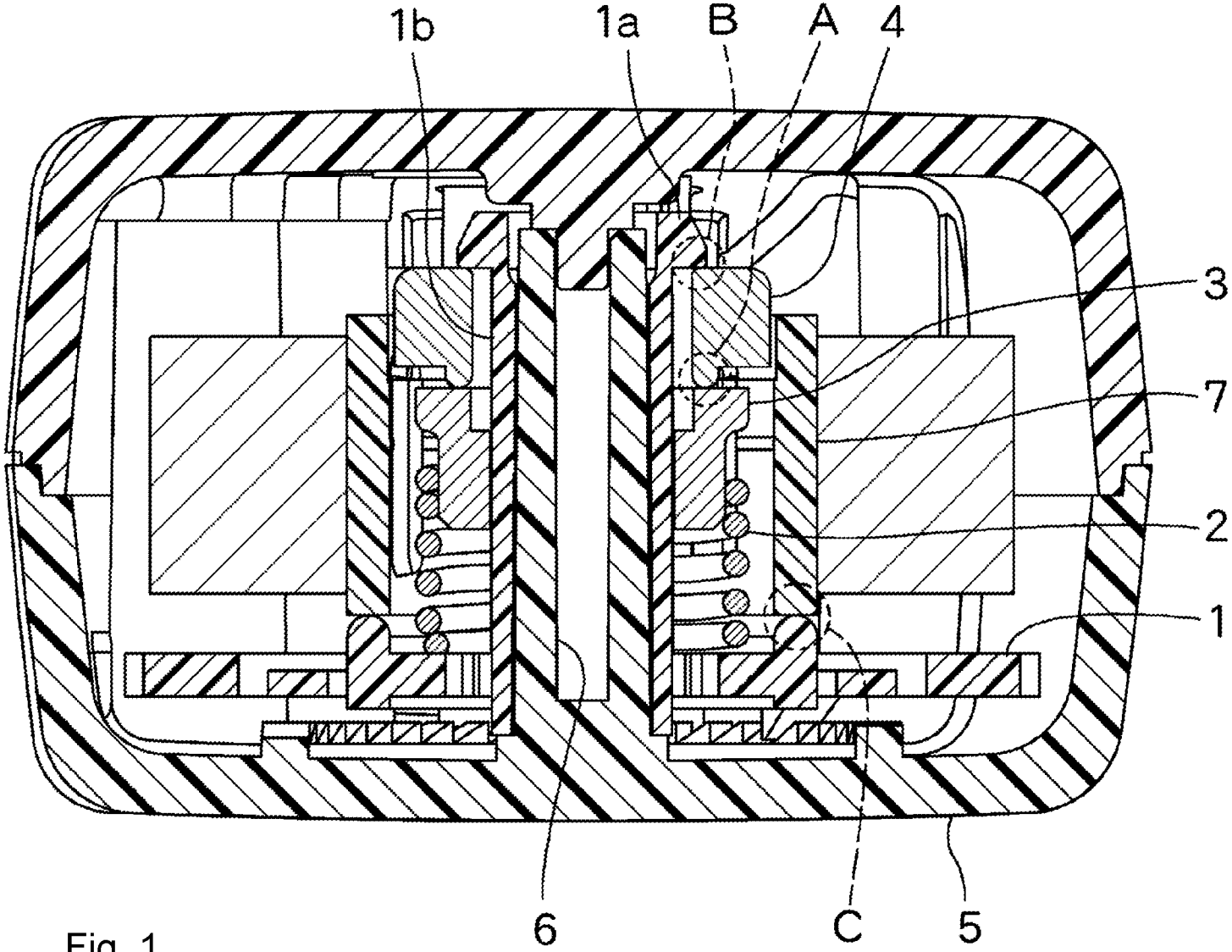
FIG. 1 illustrates Example 1 of the present invention, and is a vertical cross-sectional view taken along a center axis position of a paying-out core, which corresponds to FIG. 12.
Figure 2:
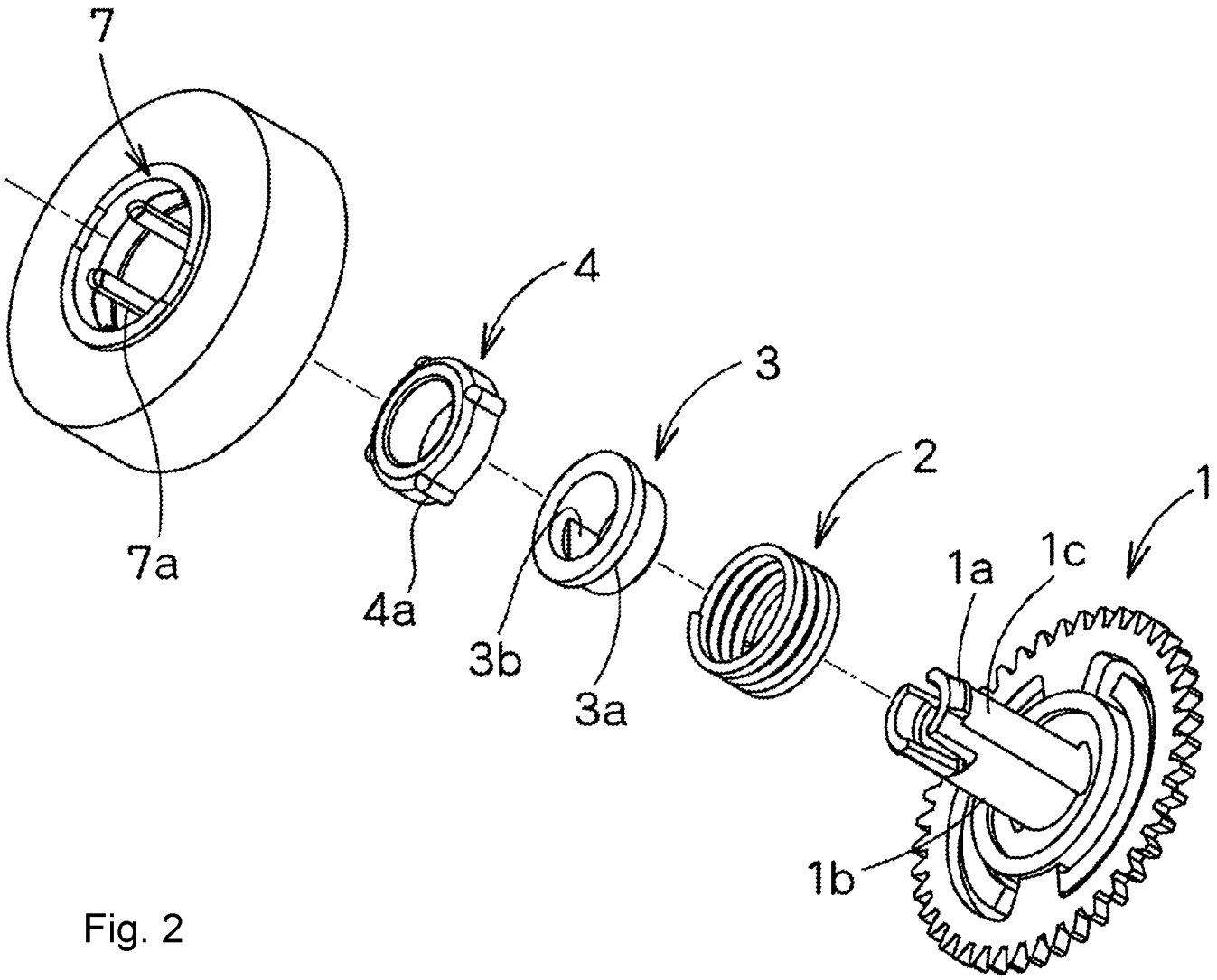
FIG. 2 is an exploded perspective view illustrating a principal portion of FIG. 1 in a reduced scale.
Figure 12:
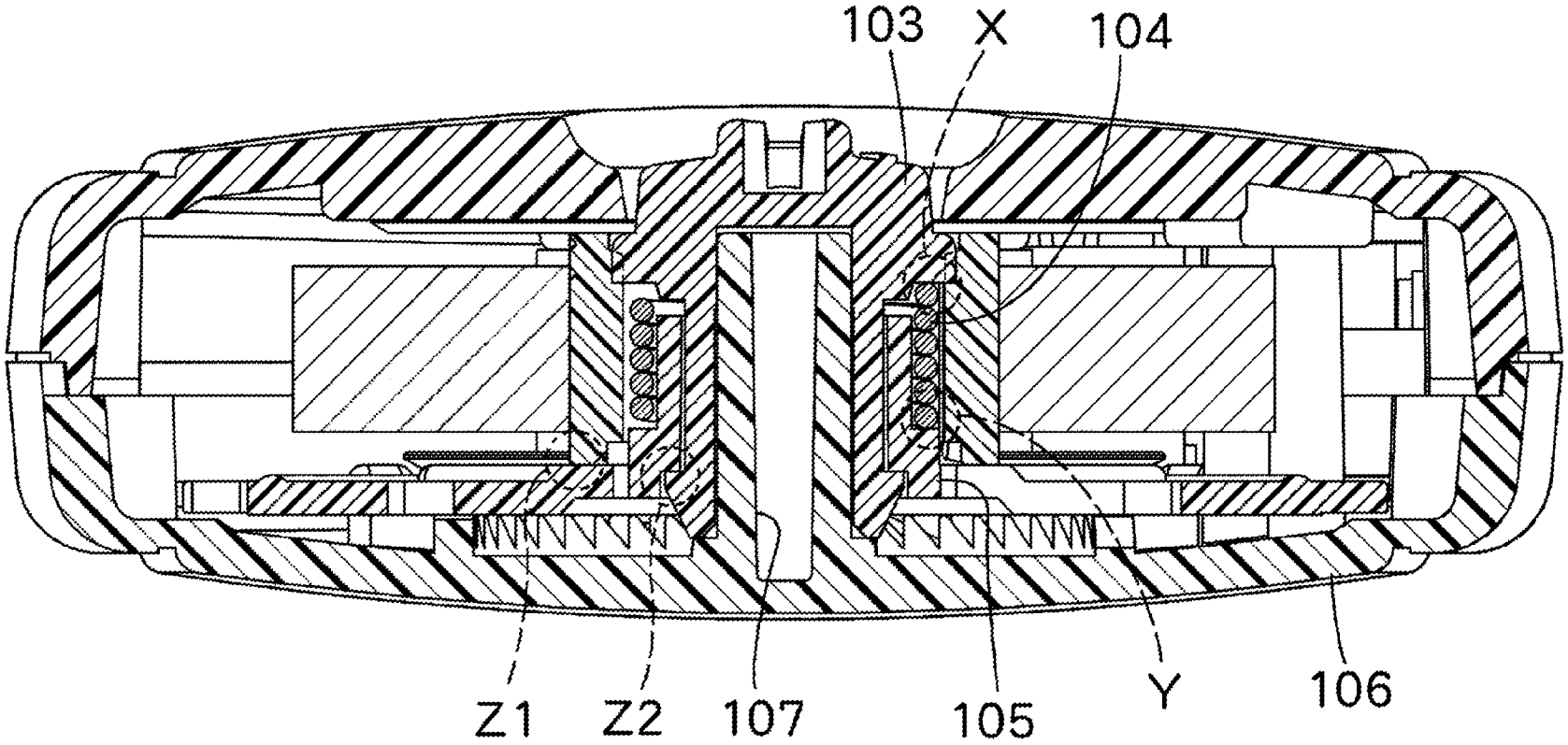
FIG. 12 is a vertical cross sectional view taken along the line XII-XII in FIG. 11.
Figure 13:
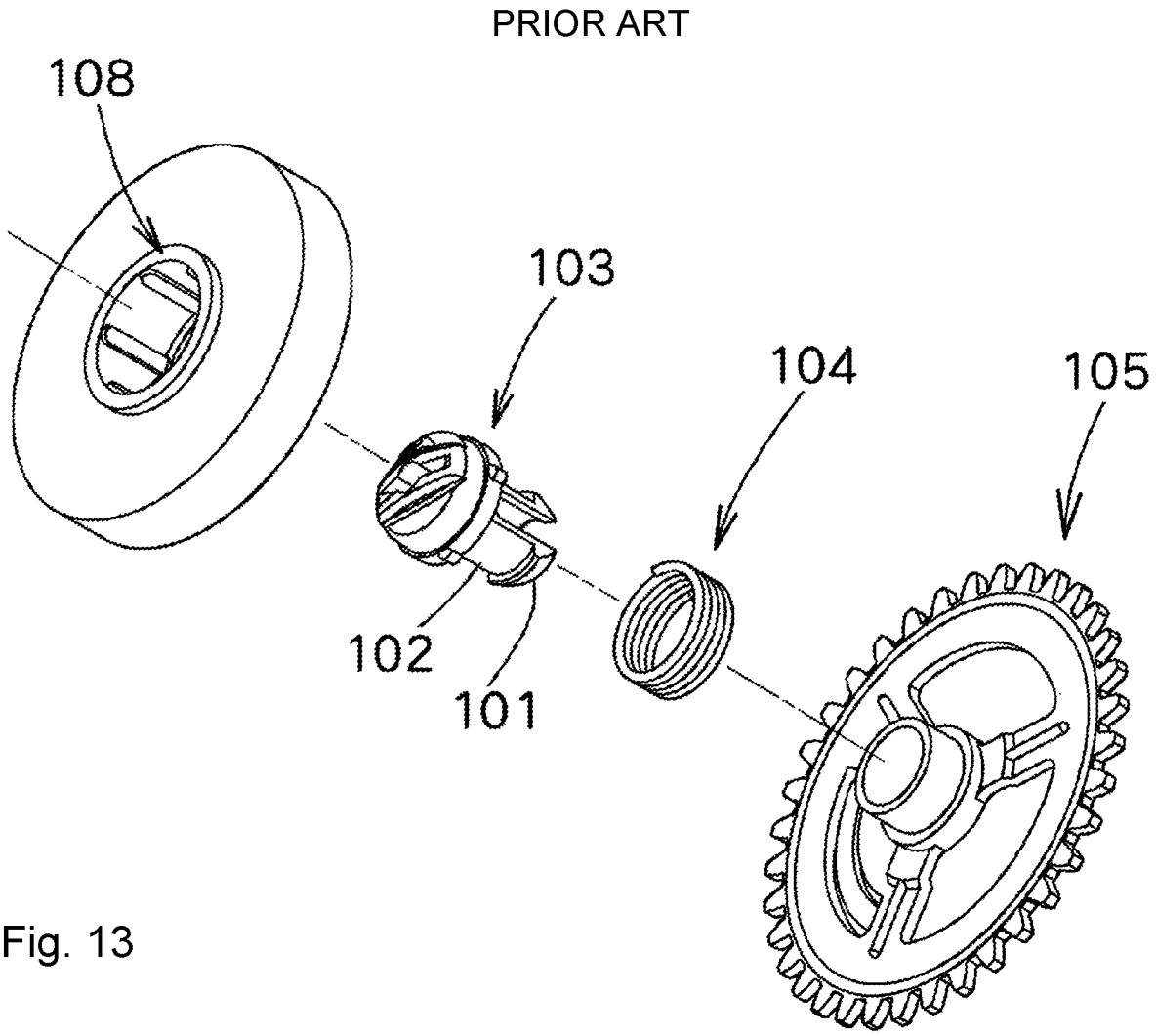
FIG. 13 is an exploded perspective view illustrating a principal portion of FIG. 12 in a reduced scale.

FIG. 1 illustrates Example 1 of the present invention, and is a vertical cross-sectional view taken along a center axis position of the paying-out core, which corresponds to FIG. 12. FIG. 2 is an exploded perspective view of a principal portion of FIG. 1 in a reduced scale.

As illustrated in FIG. 2, a paying-out core gear 1 (B component) includes a cylindrical rotating shaft 1*b* having a locking portion 1*a* at an end thereof. As illustrated in FIG. 1, a compression spring 2 (as the resilient body), an annular spacer 3 (A component), and a resilient body stopper 4 (C component) are fitted in sequence on the rotating shaft 1*b*, and are retained by the locking portion 1*a*. The rotating shaft 1*b* of the paying-out core gear 1 is rotatably fitted onto a support shaft 6 projecting inward from a case 5.

The annular spacer 3 is increased in diameter at an upper end thereof, and the compression spring 2 is interposed between a lower surface of a large diameter portion 3*a* and an upper surface of the paying-out core gear 1. A side surface of the rotating shaft 1*b* of the paying-out core gear 1 is partly cut away or notched, and an engagement piece 3*b* which is locked by a cutaway portion 1*c* is provided on an annular inner wall of the spacer 3. The paying-out core gear 1, the compression spring 2, and the spacer 3 rotate integrally by way of the engagement piece 3*b* being keyed to the cutaway portion 1*c*.

In addition, the annular resilient body stopper 4 is provided with rib-shaped locking portions 4*a* on an outer peripheral surface thereof. Locked portions 7*a*, which are to be interlocked by the rib-shaped locking portions 4*a*, are provided on an inner peripheral surface of a paying-out core 7. Accordingly, the resilient body stopper 4 rotates integrally with the paying-out core 7 by way of the rib-shaped locking portions 4*a* interlocked with the locked portions 7*a*.

Therefore, the rotational torque of the rewinding core via the power transmission mechanism includes frictional forces generated by paying out the coating film transfer tape from the paying-out core 7 via the transfer operation. These frictional forces include (1) on a sliding surface (dotted circle A) between the resilient body stopper 4 (C component) that rotates integrally with the paying-out core 7 and the spacer 3 (A component); (2) on a sliding surface (dotted circle B) between the resilient body stopper 4 and the locking portion 1*a* of the paying-out core 7; and (3) on a sliding surface (dotted circle C) between the paying-out core 7 and the paying-out core gear 1.

In this specification, the expression "rotates integrally" includes a structure that rotates basically integrally even though a small amount of relative rotation is present.

EXAMPLE 2

Figure 3:
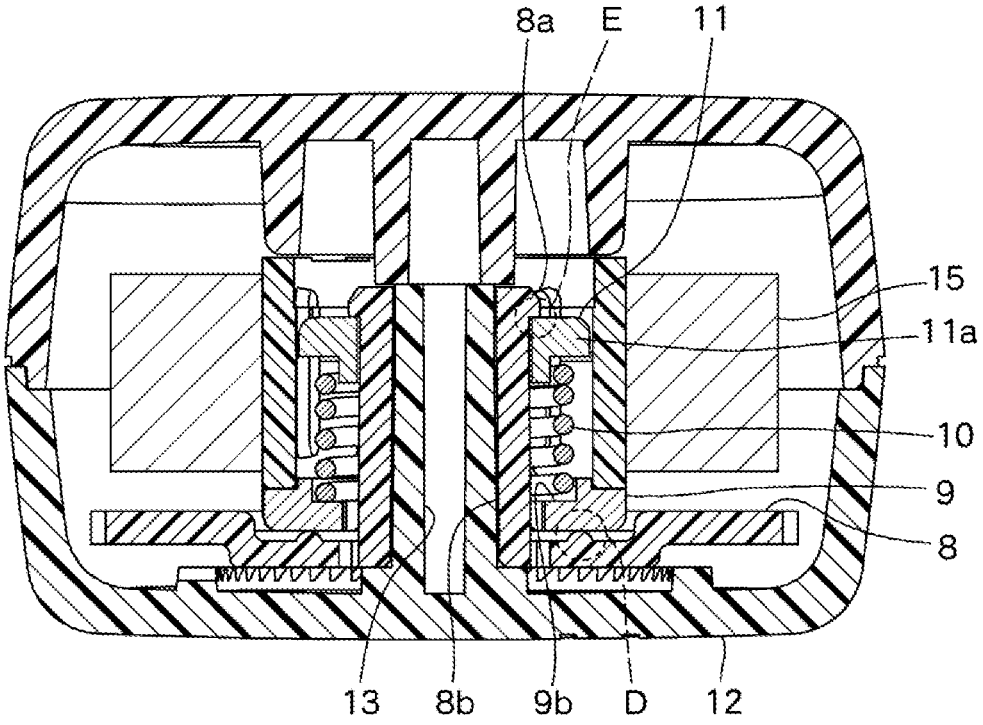
FIG. 3 illustrates Example 2 of the present invention, and is a vertical cross-sectional view taken along the center axis position of the paying-out core, which corresponds to FIG. 12.
Figure 4:
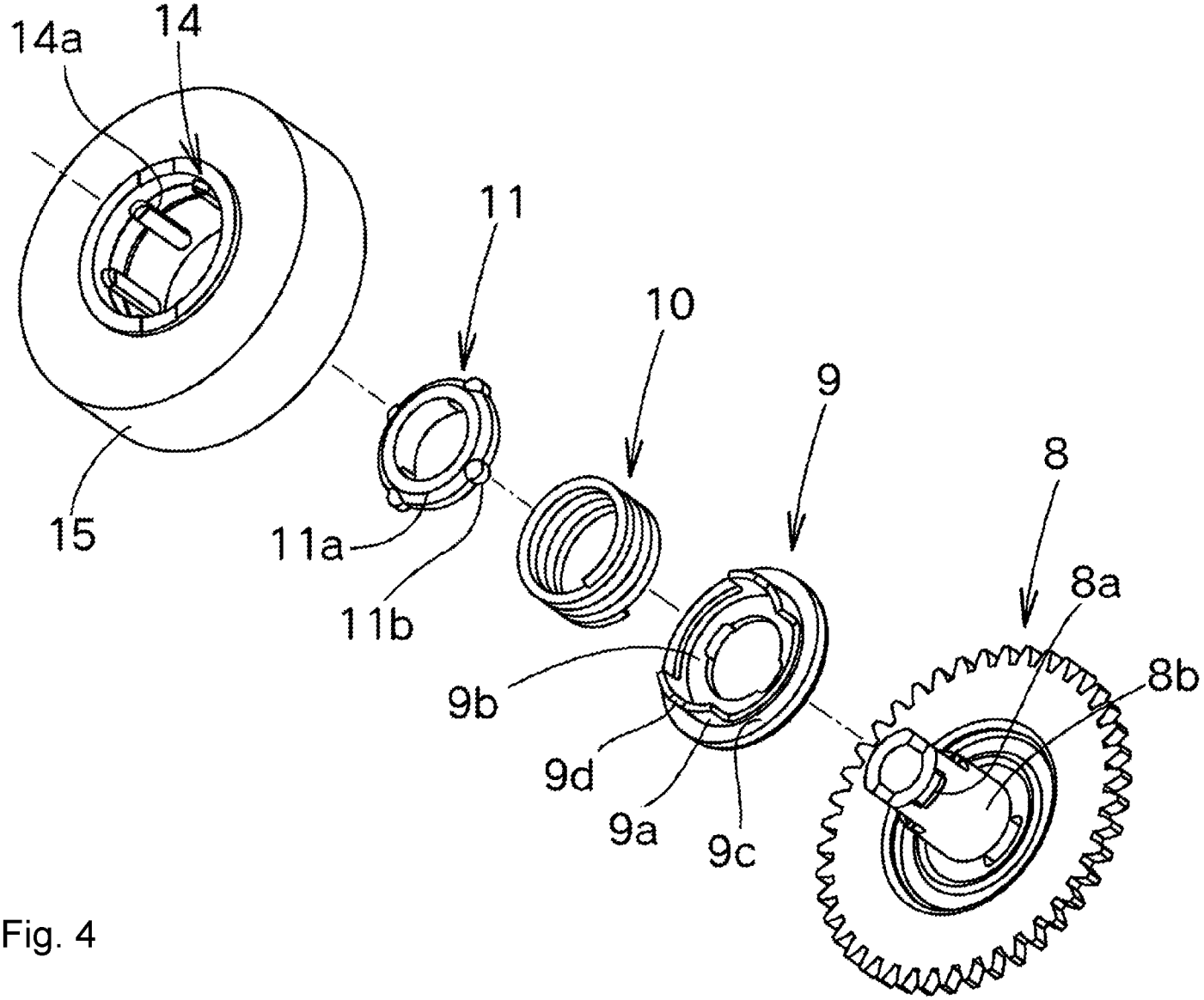
FIG. 4 is an exploded perspective view illustrating a principal portion of FIG. 3 in a reduced scale.

FIG. 3 illustrates Example 2 of the present invention, and is a vertical cross-sectional view taken along the center axis position of the paying-out core, which corresponds to FIG. 12. FIG. 4 is an exploded perspective view of a principal portion of FIG. 3 in a reduced scale.

As illustrated in FIG. 4, a paying-out core gear 8 (D component) includes a cylindrical rotating shaft 8*b* having a locking portion 8*a* at an end thereof. As illustrated in FIG. 3, an annular spacer 9 (B component), a compression spring 10, and an annular resilient body stopper 11 (A component) are fitted in sequence on the rotating shaft 8*b*, and are retained by the locking portion 8*a*. These components are rotatably fitted to a support shaft 13 projecting inward from a case 12.

The spacer 9 is provided with a pair of rising pieces 9*a* protruding from an upper surface thereof, and the rising pieces 9*a* separate the upper surface into an inner upper surface 9*b* and an outer upper surface 9*c*. The annular resilient body stopper 11 is increased in diameter at an upper end thereof, and the compression spring 10 is interposed between a lower surface of a large diameter portion 11*a* and the inner upper surface 9*b* of the spacer 9.

The spacer 9 is provided with a notch 9*d* at an upper end of each rising piece 9*a*. Locked portions 14*a* provided on an inner peripheral surface of a paying-out core 14 are interlocked by the notches 9*d*, so that the spacer 9 and the paying-out core 14 rotate integrally. The annular resilient body stopper 11 is also provided with rib-shaped locking portions 11*b* on an outer peripheral surface thereof, and the rib-shaped locking portions 11*b* interlock with the locked portions 14*a* provided on the inner peripheral surface of the paying-out core 14. Therefore, the resilient body stopper 11 rotates integrally with the paying-out core 14. Accordingly, the spacer 9 (B component), the compression spring 10, the resilient body stopper 11, and the paying-out core 14 rotate integrally.

Therefore, the rotational torque of the rewinding core via the power transmission mechanism includes frictional forces generated by paying out a coating film transfer tape 15 wound around the paying-out core 14 via the transfer operation. These frictional forces include: (1) on a sliding surface (dotted circle D) between the spacer 9 and the paying-out core gear 8; and (2) on a sliding surface (dotted circle E) between the resilient body stopper 11 and the locking portion 8*a* (C component) of the paying-out core gear 8.

EXAMPLE 3

Figure 5:
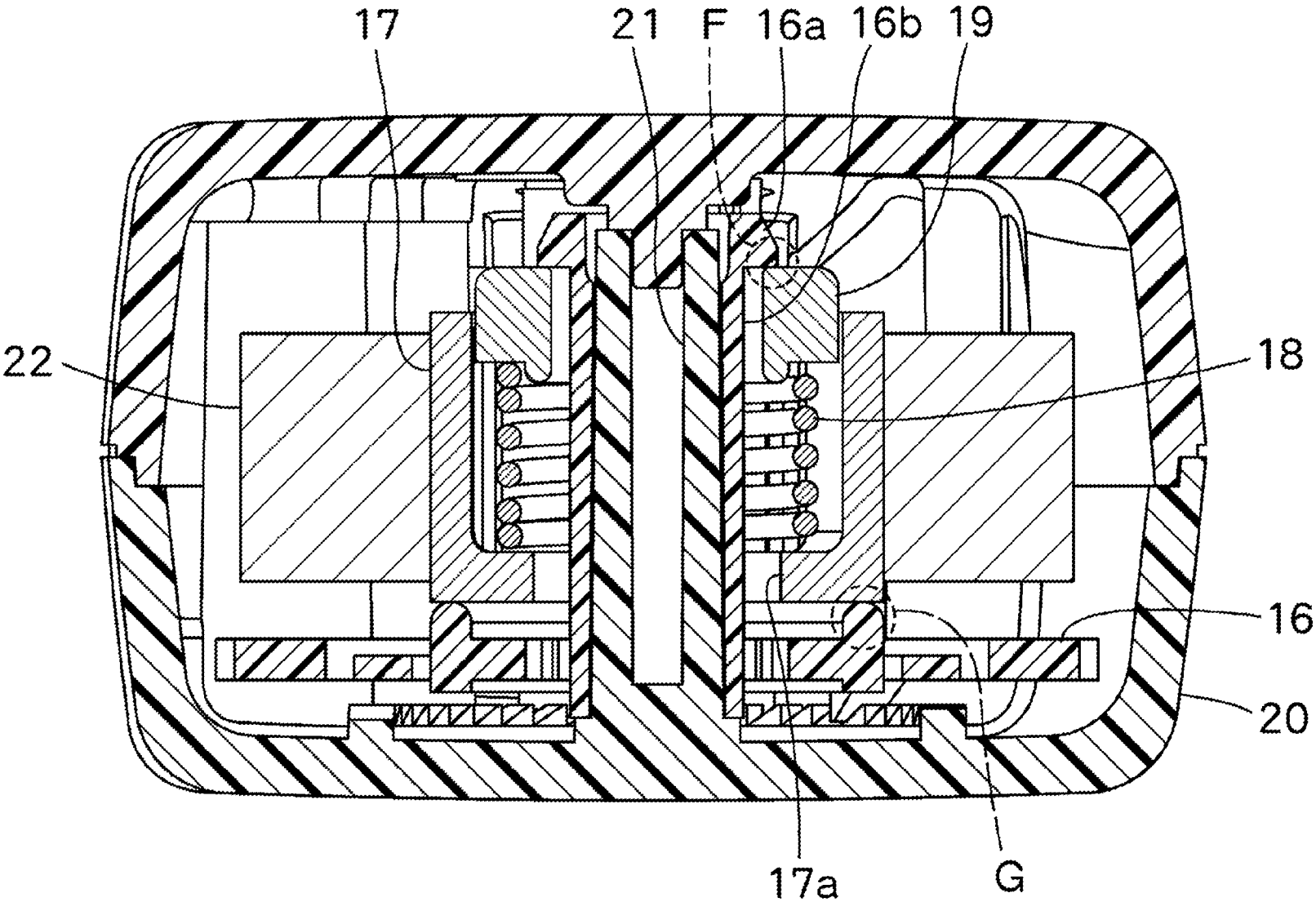
FIG. 5 illustrates Example 3 of the present invention, and is a vertical cross-sectional view taken along the center axis position of the paying-out core, which corresponds to FIG. 12.
Figure 6:
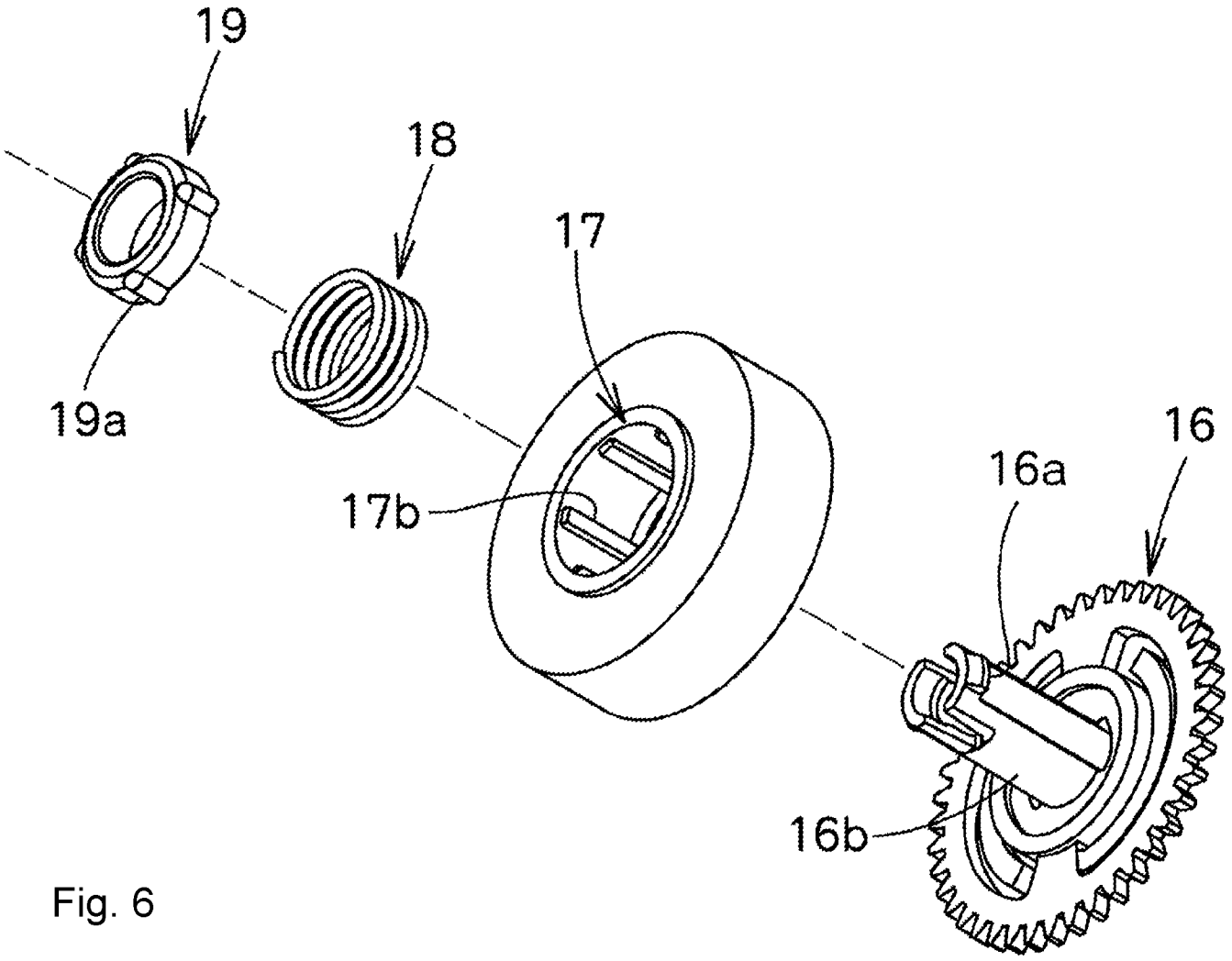
FIG. 6 is an exploded perspective view illustrating a principal portion of FIG. 5 in a reduced scale.

FIG. 5 illustrates Example 3 of the present invention, and is a vertical cross-sectional view taken along the center axis position of the paying-out core, which corresponds to FIG. 12. FIG. 6 is an exploded perspective view of a principal portion of FIG. 5 in a reduced scale.

As illustrated in FIG. 6, a paying-out core gear 16 (D component) includes a cylindrical rotating shaft 16*b* having a locking portion 16*a* at an end thereof. As illustrated in FIG. 5, a paying-out core 17, a compression spring 18, and an annular resilient body stopper 19 (A component) are fitted in sequence on the rotating shaft 16*b* and are retained by the locking portion 16*a*. The rotating shaft 16*b* of the paying-out core gear 16 is rotatably fitted to a support shaft 21 projecting inward from a case 20.

The paying-out core 17 is reduced in diameter at an end facing the paying-out core gear 16, and the compression spring 18 is interposed between an upper surface of a small diameter portion 17*a* (B component) and a lower surface of the resilient body stopper 19.

The annular resilient body stopper 19 is also provided with rib-shaped locking portions 19*a* on an outer peripheral surface thereof, and the paying-out core 17 is provided with locked portions 17*b* to be interlocked by the rib-shaped locking portions 19*a* on an inner peripheral surface thereof. The rib-shaped locking portions 19*a* interlock with the locked portions 17*b*, so that the resilient body stopper 19 rotates integrally with the paying-out core 17.

Therefore, the resilient body stopper 19, the compression spring 18, and the paying-out core 17 rotate integrally.

Therefore, the rotational torque of the rewinding core via the power transmission mechanism includes frictional forces generated by paying out a coating film transfer tape 22 wound around the paying-out core 17 via the transfer operation. These frictional forces include: (1) on a sliding surface (dotted circle F) between the resilient body stopper 19 that rotates integrally with the paying-out core 17 and the locking portion 16*a* (C component) of the paying-out core gear 16; and (2) on a sliding surface (dotted circle G) between the paying-out core 17 and the paying-out core gear 16 (D component).

EXAMPLE 4

Figure 7:
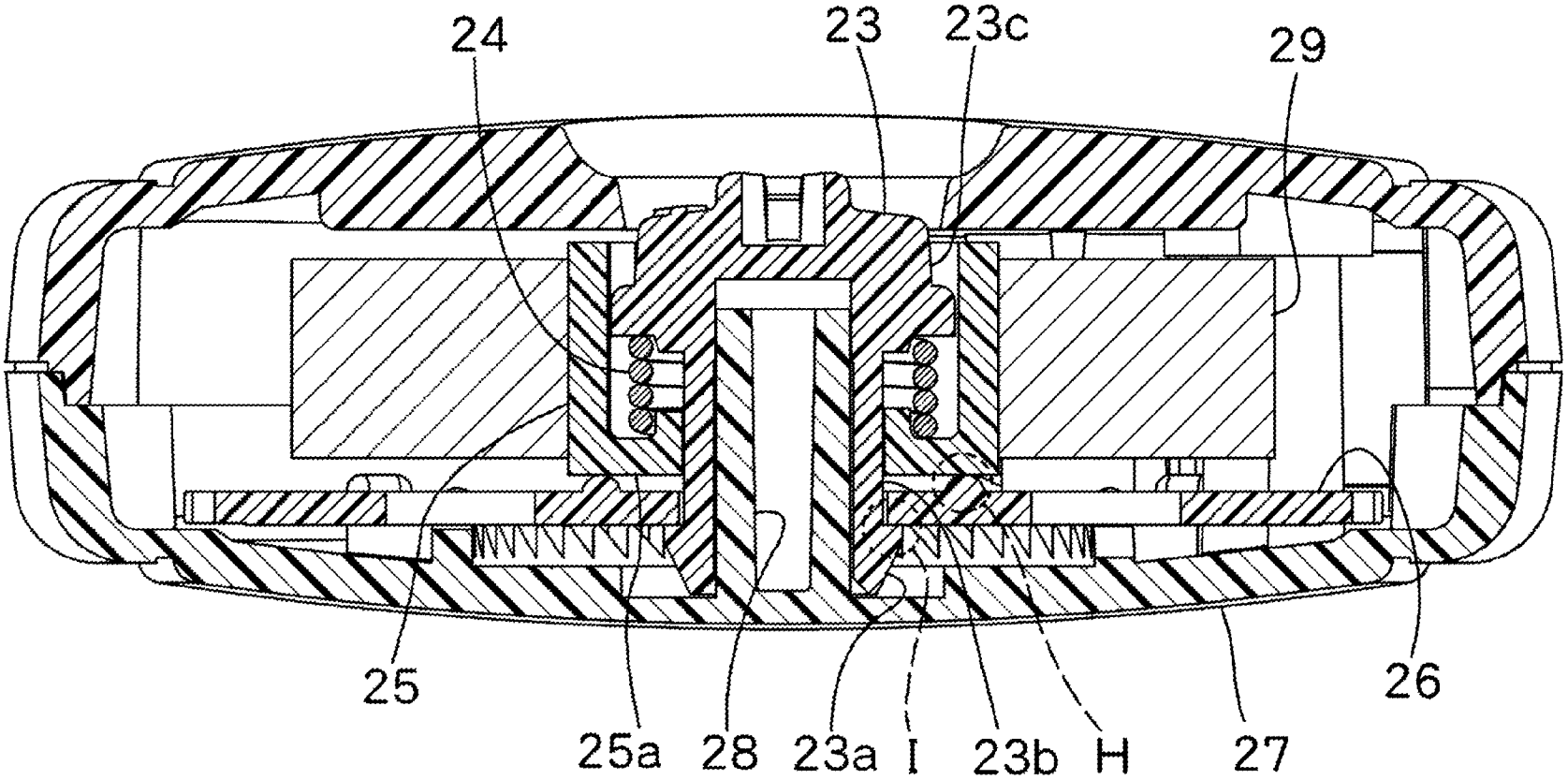
FIG. 7 illustrates Example 4 of the present invention, and is a vertical cross-sectional view taken along the center axis position of the paying-out core, which corresponds to FIG. 12.
Figure 8:
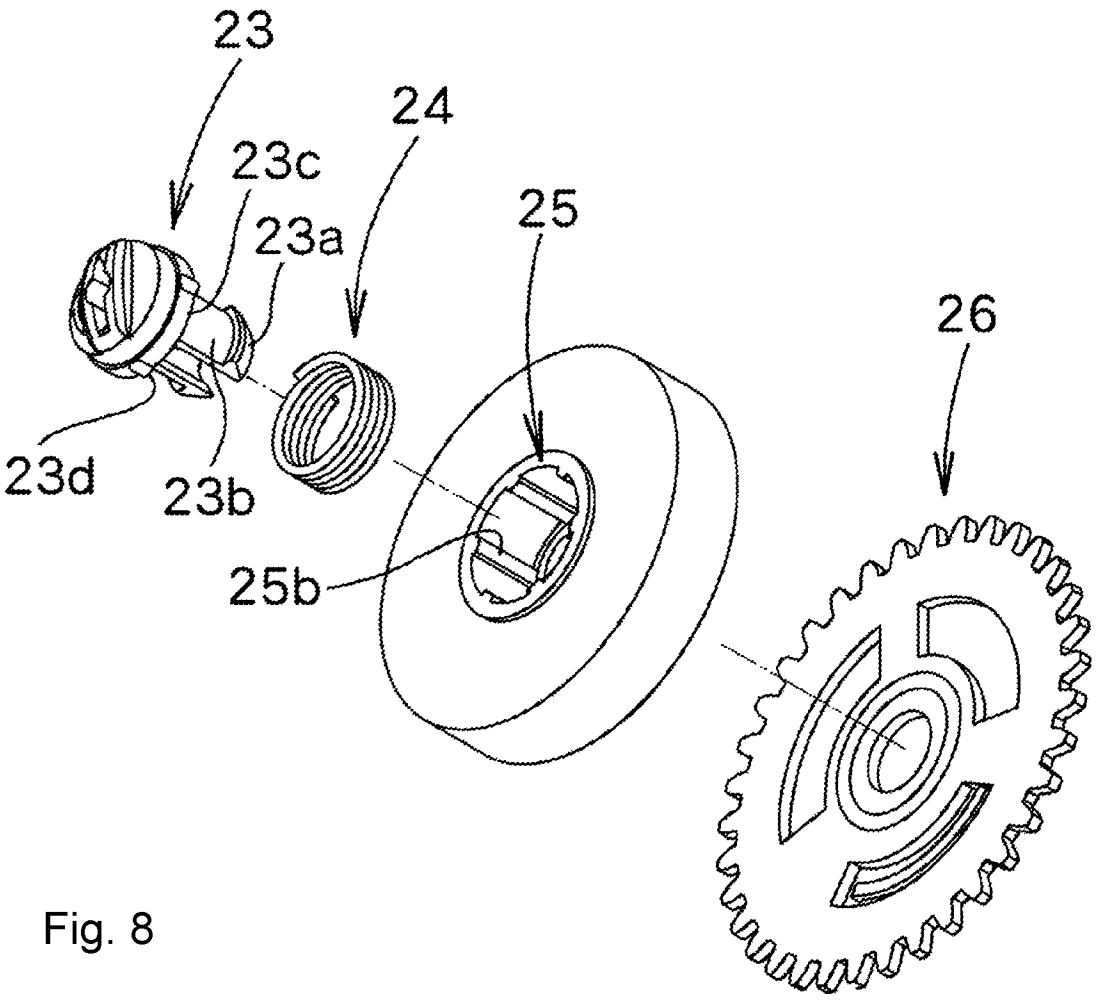
FIG. 8 is an exploded perspective view illustrating a principal portion of FIG. 7 in a reduced scale.

FIG. 7 illustrates Example 4 of the present invention, and is a vertical cross-sectional view taken along the center axis position of the paying-out core, which corresponds to FIG. 12. FIG. 8 is an exploded perspective view of a principal portion of FIG. 7 in a reduced scale.

As illustrated in FIG. 8, a rewinding button 23 (A component) includes a resilient locking piece 23*b* having a locking portion 23*a* at an end thereof. As illustrated in FIG. 7, a compression spring 24, a paying-out core 25, and a paying-out core gear 26 (D component) are fitted in sequence on the resilient locking piece 23*b* and are retained by the locking portion 23*a*. The resilient locking piece 23*b* of the rewinding button 23 is rotatably fitted to a support shaft 28 projecting inward from a case 27.

The paying-out core 25 is reduced in diameter at an end facing the paying-out core gear 26, and the compression spring 24 is interposed between an upper surface of the small diameter portion (B component) and a lower surface of a head portion 23*c* of the rewinding button 23. The rewinding button 23 is also provided with rib-shaped locking portions 23*d* on an outer peripheral surface of the head portion 23*c*, and the paying-out core 25 is provided with locked portions 25*b* where the rib-shaped locking portions 23*d* lock on an inner peripheral surface. With the rib-shaped locking portions 23*d* interlocking with the locked portions 25*b*, the rewinding button 23, the compression spring 24, and the paying-out core 25 rotate integrally.

Therefore, the rotational torque of the rewinding core via the power transmission mechanism includes frictional forces generated by paying out a coating film transfer tape 29 wound around the paying-out core 25 via the transfer operation. These frictional forces include: (1) on a sliding surface (dotted circle H) between the paying-out core 25 and the paying-out core gear 26; and (2) on a sliding surface (dotted circle I) between the paying-out core gear 26 and the locking portion 23*a* of the resilient locking piece 23*b* of the rewinding button 23.

The rewinding button 23 has been illustrated here thus far. However, a stop button may be provided, with the resilient locking piece 23*b* having the locking portion 23*a* in the same manner as the rewinding button 23 without having the winding function.

EXAMPLE 5

Figure 9:
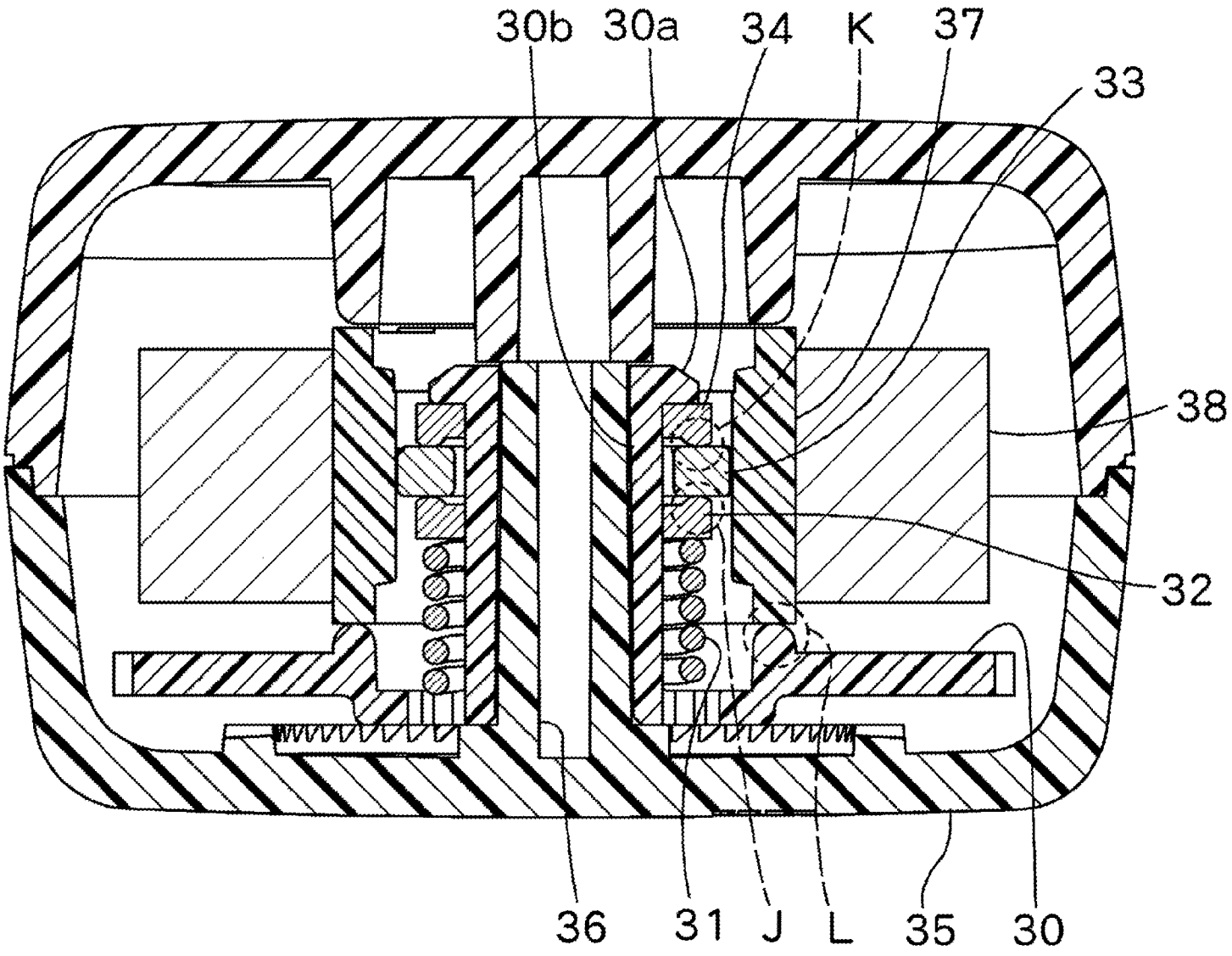
FIG. 9 illustrates Example 5 of the present invention, and is a vertical cross-sectional view taken along the center axis position of the paying-out core, which corresponds to FIG. 12.
Figure 10:
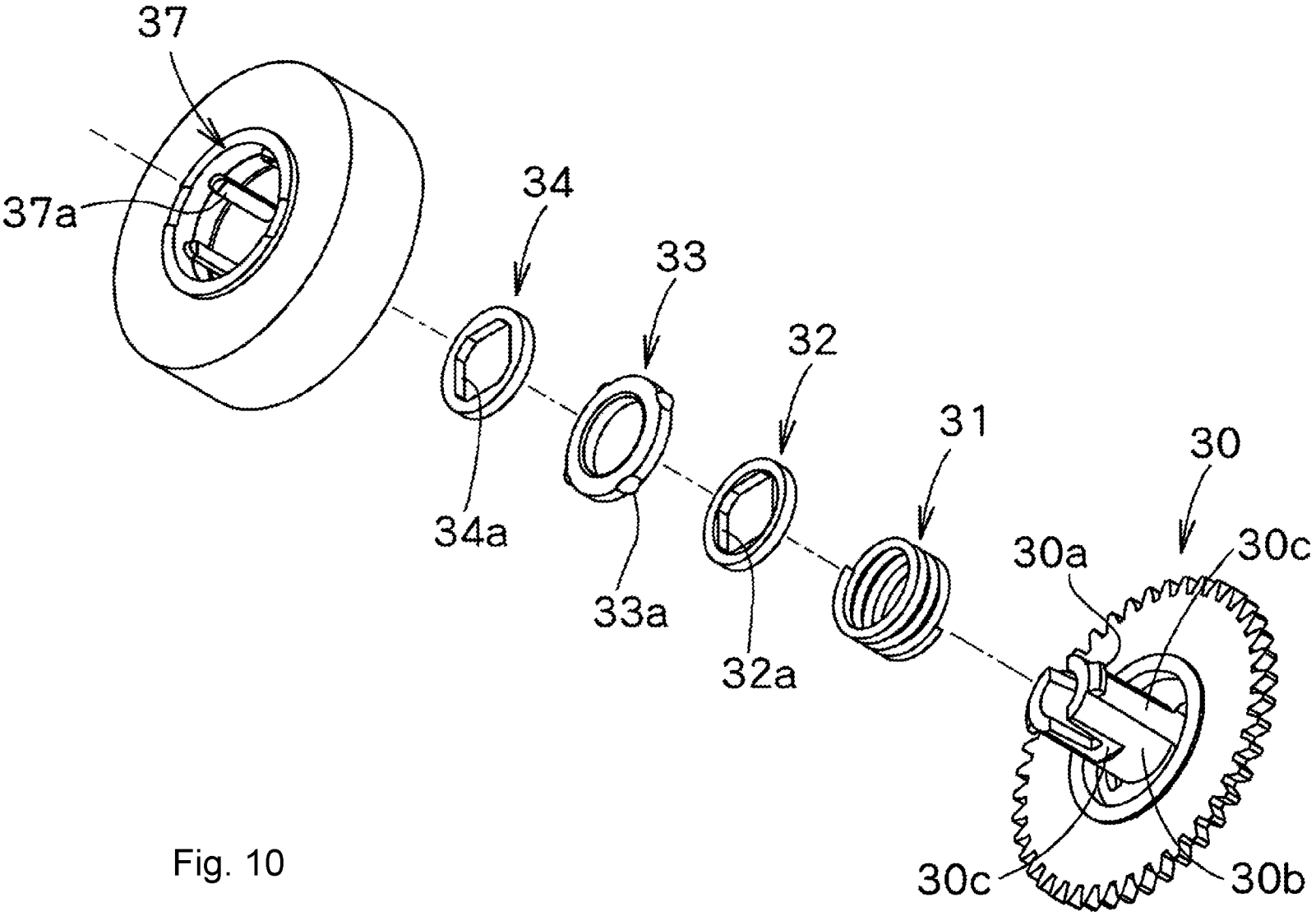
FIG. 10 is an exploded perspective view illustrating a principal portion of FIG. 9 in a reduced scale.
Figure 11:
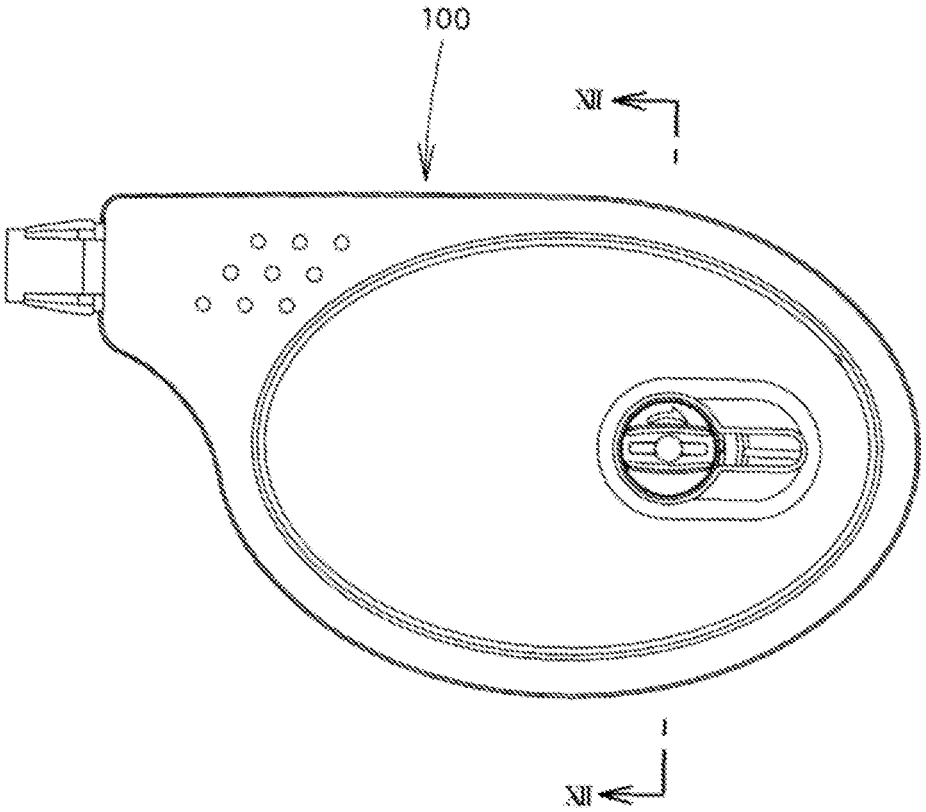
FIG. 11 is a front view of a generally available coating film transfer tool of the related art.

FIG. 9 illustrates Example 5 of the present invention, and is a vertical cross-sectional view taken along the center axis position of the paying-out core, which corresponds to FIG. 12. FIG. 10 is an exploded perspective view of a principal portion of FIG. 9 in a reduced scale.

As illustrated in FIG. 10, a paying-out core gear 30 (B component) includes a cylindrical rotating shaft 30*b* having a locking portion 30*a* at an end thereof. As illustrated in FIG. 9, a compression spring 31, an annular first spacer 32 (A component), an annular resilient body stopper 33 (C component), and an annular second spacer 34 are fitted in sequence on the rotating shaft 30*b* and are retained by the locking portion 30*a*. The rotating shaft 30*b* of the paying-out core gear 30 is rotatably fitted to a support shaft 36 projecting inward from a case 35.

The annular resilient body stopper 33 is also provided with rib-shaped locking portions 33*a* on an outer peripheral surface thereof, and a paying-out core 37 is provided with locked portions 37*a* to be interlocked by the rib-shaped locking portion 33*a* on an inner peripheral surface thereof. The rib-shaped locking portions 33*a* interlock with the locked portions 37*a*, so that the resilient body stopper 33 rotates integrally with the paying-out core 37.

An upper half of an outer peripheral surface of the rotating shaft 30*b* of the paying-out core gear 30 is cut out substantially equidistantly to form planar sections 30*c* at four positions, and inner holes 32*a*, 34*a* of the first spacer 32 and the second spacer 34 have a square shape having arcuate corners (in plan view). The first spacer 32 and the second spacer 34 may be fitted to the rotating shaft 30*b* of the paying-out core gear 30 so as not to be capable of rotating, whereby the paying-out core gear 30, the compression spring 31, the first spacer 32, and the second spacer 34 rotate integrally.

Therefore, the rotational torque of the rewinding core via the power transmission mechanism includes frictional forces generated by paying out a coating film transfer tape 38 wound around the paying-out core 37 via the transfer operation. These frictional forces include: (1) on a sliding surface (dotted circle J) between the first spacer 32 and the resilient body stopper 33, (2) on a sliding surface (dotted circle K) between the resilient body stopper 33 and the second spacer 34, and (3) on a sliding surface (dotted circle L) between the paying-out core 37 and the paying-out core gear 30.

In contrast to Example 1, two spacers 32, 34 are used in Example 5. Therefore, the rotational torque of the rewinding core may be advantageously adjusted by adjusting upper and lower sliding surfaces of the resilient body stopper 33.

Additional Illustrative Combinations

A. An automatically winding type coating film transfer tool comprising: a paying-out core having a coating film transfer tape wound thereon; and a rewinding core that rewinds the coating film transfer tape after use, the paying-out core and the rewinding core being interlocked via a power transmission mechanism in a case and generating a rotational torque of the rewinding core or of the paying-out core by a frictional force generating on a sliding surface between components by using a restoring force of a resilient body, wherein the resilient body is configured to rotate integrally with a component A that comes into contact with one end of the resilient body and a component B that comes into contact with the other end.

B. The coating film transfer tool in accordance with paragraph A, wherein the resilient body is a compression spring.

C. The coating film transfer tool in accordance with paragraphs A or B, wherein a frictional force generating on a sliding surface between a C component, which is positioned on an opposite side of the resilient body with respect to the A component positioned in-between, and the A component by sliding contact therebetween serves as at least part of the rotational torque of the rewinding core or of the paying-out core.

D. The coating film transfer tool in accordance with paragraphs A to C, wherein a frictional force generating on a sliding surface between a D component, which is positioned on an opposite side of the resilient body with respect to the B component positioned in-between, and the B component by sliding contact therebetween serves as at least part of the rotational torque of the rewinding core or of the paying-out core.

E. The coating film transfer tool in accordance with paragraph C, wherein three members of the resilient body, an annular spacer (A component), and an annular resilient body stopper (C component) rotating integrally with the paying-out core are fitted in sequence on a cylindrical rotating shaft of a paying-out core gear (component B) having a locking portion at an end thereof and are retained by the locking portion, the rotational shaft of the paying-out core gear is rotatably fitted on a support shaft projecting inward of the case, and the paying-out core gear and the resilient body and the spacer rotate integrally, so that frictional forces generating on a sliding surface between the spacer and the resilient body stopper and a sliding surface between the resilient body stopper and the locking portion of the paying-out core gear serve as at least part of the rotational torque of the rewinding core via the power transmission mechanism.

F. The coating film transfer tool in accordance with paragraph D that quotes in accordance with paragraph C, wherein three members of an annular spacer (B component), the resilient body, and an annular resilient body stopper (A component) rotating integrally with the paying-out core are fitted in sequence on a cylindrical rotating shaft of a paying-out core gear (D component) having a locking portion at an end thereof and are retained by the locking portion, the rotating shaft of the paying-out core gear is rotatably fitted on a support shaft projecting inward of the case, the spacer and the resilient body and the resilient body stopper rotate integrally, so that frictional forces generating on a sliding surface between the spacer and the paying-out core gear and a sliding surface between the resilient body stopper and the paying-out core gear and the locking portion (C component) thereof serve as at least part of the rotational torque of the rewinding core via the power transmission mechanism.

G. The coating film transfer tool in accordance with paragraph D that quotes in accordance with paragraph C, wherein three members of a small diameter portion (B component) of the paying-out core, which is reduced in diameter at an end facing a paying-out core gear, the resilient body, and an annular resilient body stopper (A component) are fitted in sequence on a cylindrical rotating shaft of the paying-out core gear (D component) having a locking portion at an end thereof and are retained by the locking portion, the rotating shaft of the paying-out core gear is rotatably fitted on a support shaft projecting inward of the case, the paying-out core and the resilient body and the resilient body stopper rotate integrally, so that frictional forces generating on a sliding surface between the paying-out core and the paying-out core gear (D component) and a sliding surface between the resilient body stopper and of the locking portion (C component) the paying-out core gear serve as at least part of the rotational torque of the rewinding core via the power transmission mechanism.

H. The coating film transfer tool in accordance with paragraph D that quotes in accordance with paragraph A or B, wherein three members of the resilient body, a small diameter portion (B component) of the paying-out core, which is reduced in diameter at an end facing a paying-out core gear (D component), and the paying-out core gear are fitted in sequence on a resilient locking piece of a stop button (A component) having a locking portion at an end thereof and are retained by the locking portion, the resilient locking piece of the stop button is rotatably fitted on a support shaft projecting inward of the case, the stop button and the resilient body and the paying-out core rotate integrally, so that frictional forces generating on a sliding surface between the paying-out core and the paying-out core gear and a sliding surface between the paying-out core gear and the locking portion of the resilient locking piece of the stop button serve as at least part of the rotational torque of the rewinding core via the power transmission mechanism.

I. The coating film transfer tool in accordance with paragraph C, wherein four members of the resilient body, an annular first spacer (A component), an annular resilient body stopper (C component) rotating integrally with the paying-out core, and an annular second spacer are fitted in sequence on a cylindrical rotating shaft of a paying-out core gear (component B) having a locking portion at an end thereof and are retained by the locking portion, the rotating shaft of the paying-out core gear is rotatably fitted on a support shaft projecting inward of the case, the paying-out core gear and the resilient body, and the first spacer and the second spacer rotate integrally, so that frictional forces generating on a sliding surface between the first spacer and the resilient body stopper and a sliding surface between the resilient body stopper and the second spacer serve as at least part of the rotational torque of the rewinding core via the power transmission mechanism.

Although the representative five embodiments have been described thus far, the present invention is not limited to these embodiments. Only the structure in which component that comes into contact with the resilient body such as the compression spring or the O-ring rotates integrally with the resilient body is essential, and various structures may be employed.

REFERENCE SIGNS LIST

1 paying-out core gear
1*a* locking portion
1*b* rotating shaft
1*c* nocked portion
2 compression spring
3 spacer
3*a* large diameter portion
3*b* locked piece
4 resilient body stopper
4*a* rib-shaped locking portion
5 case
6 support shaft
7 paying-out core
7*a* locked portion
8 paying-out core gear
8*a* locking portion
8*b* rotating shaft
9 spacer
9*a* rising piece
9*b* inner upper surface
9*c* outer upper surface
9*d* notch
10 compression spring
11 resilient body stopper
11*a* large diameter portion
11*b* rib-shaped locking portion
12 case
13 support shaft
14 paying-out core
14*a* locked portion
15 coating film transfer tape
16 paying-out core gear
16*a* locking portion
16*b* rotating shaft
17 paying-out core
17*a* small diameter portion
17*b* locked portion
18 compression spring
19 resilient body stopper
19*a* rib-shaped locking portion
20 case
21 support shaft
22 coating film transfer tape
23 rewinding button
23*a* locking portion
23*b* resilient locking piece
23*c* head portion
23*d* rib-shaped locking portion
24 compression spring
25 paying-out core
25*a* small diameter portion
25*b* locked portion
26 paying-out core gear
27 case
28 support shaft
29 coating film transfer tape
30 paying-out core gear
30*a* locking portion
30*b* rotating shaft
30*c* planar section
31 compression spring
32 first spacer
32*a* inner hole
33 resilient body stopper
33*a* rib-shaped locking portion
34 second spacer
34*a* inner hole
35 case
36 support shaft
37 paying-out core
37*a* locked portion
38 coating film transfer tape

100 coating film transfer tool
101 locking portion
102 resilient locking piece
103 rewinding button
104 compression spring
105 paying-out core gear
106 case
107 support shaft
108 paying-out core

What is claimed is:

1. An automatically winding type coating film transfer tool comprising:

a paying-out core having a coating film transfer tape wound thereon; and a rewinding core configured to rewind the coating film transfer tape after use, the paying-out core and the rewinding core being interlocked via a power transmission mechanism in a case, the power transmission mechanism having a first locking mechanism and a second locking mechanism;

wherein the power transmission mechanism is configured to generate a rotational torque of the rewinding core or of the paying-out core by a frictional force generated on a sliding surface using a restoring force of a resilient body; and wherein the resilient body, a first component of the power transmission mechanism that comes into contact with one end of the resilient body, and a second component of the power transmission mechanism that comes into contact with another end of the resilient body are configured to rotate integrally by way of the first and second locking mechanisms being locked together in a form fit connection.

2. The coating film transfer tool according to claim 1, wherein the resilient body is a compression spring.

3. The coating film transfer tool according to claim 1, wherein a portion of the rotational torque is generated by a frictional force on a sliding surface between a third component and the first component, wherein the third component is disposed on an opposite side of the first component with respect to the resilient body.

4. The coating film transfer tool according to claim 1, wherein a portion of the rotational torque is generated by a frictional force on a sliding surface between a fourth component and the second component, wherein the fourth component is disposed on an opposite side of the second component with respect to the resilient body.

5. The coating film transfer tool according to claim 4, wherein the second component comprises an annular spacer, the first component comprises an annular resilient body stopper, and the fourth component comprises a paying-out core gear;

wherein the annular spacer, the resilient body, and the annular resilient body stopper are fitted in sequence on a cylindrical shaft of the paying-out core gear and are retained by a locking portion at an end of the shaft;

wherein the shaft of the paying-out core gear is rotatably fitted on a support shaft projecting inward from the case; and wherein the spacer and the resilient body and the resilient body stopper rotate integrally, such that at least a part of the rotational torque of the rewinding core is caused by frictional forces generated on a sliding surface between the spacer and the paying-out core gear and on a sliding surface between the resilient body stopper and the paying-out core gear and the locking portion thereof.

6. The coating film transfer tool according to claim 5, wherein the annular resilient body stopper includes rib-shaped locking portions on an outer peripheral surface thereof, and the paying-out core includes, on an inner peripheral surface thereof, locked portions configured to be locked by the rib-shaped locking portions.

7. The coating film transfer tool according to claim 1, wherein the first locking mechanism comprises an engagement piece and the second locking mechanism comprises a cutaway portion.

8. The coating film transfer tool according to claim 7, wherein the form fit connection comprises a keyed connection between the engagement piece and the cutaway portion.

* * * * *